US012078369B2

(12) United States Patent
Liu et al.

(10) Patent No.: US 12,078,369 B2
(45) Date of Patent: Sep. 3, 2024

(54) AIR CONDITIONER ANTI-FROSTING CONTROL METHOD AND APPARATUS

(71) Applicant: GREE ELECTRIC APPLIANCES, INC. OF ZHUHAI, Zhuhai (CN)

(72) Inventors: Hua Liu, Zhuhai (CN); Wei Wang, Zhuhai (CN); Shimin Liang, Zhuhai (CN); Yuying Sun, Zhuhai (CN); Dexing Duan, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 500 days.

(21) Appl. No.: 17/438,255

(22) PCT Filed: Dec. 23, 2019

(86) PCT No.: PCT/CN2019/127443
§ 371 (c)(1),
(2) Date: Sep. 10, 2021

(87) PCT Pub. No.: WO2020/181874
PCT Pub. Date: Sep. 17, 2020

(65) Prior Publication Data

US 2022/0186961 A1 Jun. 16, 2022

(30) Foreign Application Priority Data

Mar. 13, 2019 (CN) ..... 201910189938.5

(51) Int. Cl.
*F24F 11/42* (2018.01)
*F24F 11/63* (2018.01)

(52) U.S. Cl.
CPC ..... *F24F 11/42* (2018.01); *F24F 11/63* (2018.01)

(58) Field of Classification Search
CPC .. F24F 11/42; F24F 11/63; F24F 11/64; F24F 2110/12; F24F 2120/12
(Continued)

(56) References Cited

U.S. PATENT DOCUMENTS 4,627,484 A 12/1986 Harshbarger, Jr. et al.
4,850,204 A * 7/1989 Bos ..... F25D 21/006 62/155
(Continued)

FOREIGN PATENT DOCUMENTS

CN 101793429 A 8/2010
CN 102352860 A 2/2012
(Continued)

OTHER PUBLICATIONS

International Search Report issued Mar. 25, 2020 in PCT/CN2019/127443 (submitting English translation only), 3 pages.
(Continued)

*Primary Examiner* — Eric S Ruppert
*Assistant Examiner* — Kirstin U Oswald
(74) *Attorney, Agent, or Firm* — Oblon, McClelland, Maier & Neustadt, L.L.P.

(57) ABSTRACT

The present disclosure relates to an air conditioner anti-frosting control method and apparatus. The air conditioner anti-frosting control method includes: acquiring a frosting map of a unit and a meteorological condition of an area where the unit is located, and calculating an average defrosting frequency of the unit according to the frosting map; determining a target defrosting frequency according to the average defrosting frequency; and determining a heat exchange temperature difference according to the target defrosting frequency, and controlling the unit to operate according to the heat exchange temperature difference.

12 Claims, 4 Drawing Sheets

(58) Field of Classification Search
USPC ..... 62/80
See application file for complete search history.

(56) References Cited

U.S. PATENT DOCUMENTS

| | | | | | |
|---|---|---|---|---|---|
| 4,884,414 | A * | 12/1989 | Bos | F25D 21/006 | 62/155 |
| 5,319,940 | A * | 6/1994 | Yakaski | F25B 47/022 | 62/278 |
| 5,415,005 | A * | 5/1995 | Sterber | F25D 21/006 | 62/154 |
| 5,515,689 | A * | 5/1996 | Atterbury | F25D 21/006 | 62/155 |
| 5,564,286 | A * | 10/1996 | Suse | F25D 21/006 | 62/155 |
| 5,727,395 | A * | 3/1998 | Guo | F25D 21/006 | 62/155 |
| 5,797,273 | A * | 8/1998 | Guo | F25B 13/00 | 62/155 |
| 5,927,083 | A * | 7/1999 | Guo | F25D 21/006 | 62/155 |
| 6,318,095 | B1 * | 11/2001 | Guo | F25B 47/025 | 62/80 |
| 6,715,304 | B1 * | 4/2004 | Wycoff | F25D 21/002 | 62/155 |
| 2003/0140638 | A1 * | 7/2003 | Arshansky | F25D 17/02 | 62/278 |
| 2007/0180838 | A1 * | 8/2007 | Shah | F25D 21/008 | 62/157 |
| 2009/0217684 | A1 * | 9/2009 | Ouchi | F25D 21/002 | 62/155 |
| 2011/0088415 | A1 * | 4/2011 | Lacey | F25D 21/006 | 62/155 |
| 2015/0047375 | A1 * | 2/2015 | Qu | F24F 11/42 | 62/155 |
| 2017/0176072 | A1 * | 6/2017 | Gokhale | F25B 41/39 | |
| 2018/0224176 | A1 | 8/2018 | Shen et al. | | |
| 2020/0223398 | A1 * | 7/2020 | Hoshino | B60H 1/00785 | |

FOREIGN PATENT DOCUMENTS

| | | | |
|---|---|---|---|
| CN | 102853502 | A | 1/2013 |
| CN | 103362850 | A | 10/2013 |
| CN | 104847675 | A | 8/2015 |
| CN | 104930771 | A | 9/2015 |
| CN | 105716340 | A | 6/2016 |
| CN | 205858729 | U | 1/2017 |
| CN | 106482408 | A | 3/2017 |
| CN | 106766019 | A | 5/2017 |
| CN | 109519414 | A | 3/2019 |
| CN | 109631440 | A | 4/2019 |
| CN | 109915999 | A | 6/2019 |
| CN | 209012123 | U | 6/2019 |
| JP | 9-126603 | A | 5/1997 |
| KR | 10 2014 102 078 | A1 | 8/2015 |
| WO | WO 2018/091250 | A1 | 5/2018 |

OTHER PUBLICATIONS

J. H. Zhu et al., "Developing a New Frosting Map to Guide Defrosting Control for Air-Source Heat Pump Units" Applied Thermal Engineering, vol. 90, Jul. 8, 2015, pp. 782-791.

Jiahe Zhu, et al., "A Novel Temperature-Humidity-Time Defrosting Control Method Based on a Frosting Map for Air-Source Heat Pumps" International Journal of Refrigeration, 2015, pp. 45-54.

* cited by examiner

AIR CONDITIONER ANTI-FROSTING CONTROL METHOD AND APPARATUS

CROSS-REFERENCE TO RELATED APPLICATIONS

The present disclosure is based upon and claims priority to Chinese Patent Application No. 201910189938.5, filed on Mar. 13, 2019, the entire contents of all of which are incorporated herein by reference.

FIELD OF THE DISCLOSURE

The present disclosure relates to the technical field of air conditioner, and more particularly, to an air conditioner anti-frosting control method and apparatus.

BACKGROUND OF THE DISCLOSURE

"Air source heat pump" is an energy-saving technology that has attracted much attention all over the world in recent years. As a renewable energy technology, it has become an important building energy form and is widely used in cold and hot summer and cold (warm) winter areas, with wide application space and value.

The air source heat pump takes ambient air as a heat source and has the following main characteristics: ① the ambient air is taken as the heat source, so it exists everywhere in space, is always available in time and may be taken as required; ② low-quality heat energy which cannot be applied is converted into high-quality heat energy which can be directly applied for air conditioners and domestic hot water; and ③ part of the heat which is dissipated to the atmosphere through a building envelope is recovered, so that the energy is recycled.

In related art known by the inventor, when the air source heat pump operates in winter, an outer heat exchanger is sometimes under the frosting working condition.

SUMMARY OF THE DISCLOSURE

According to one aspect of embodiments of the present disclosure, an air conditioner anti-frosting control method is provided. The conditioner anti-frosting control method includes: determining an average defrosting frequency of a unit in a current climate; determining a target defrosting frequency according to the average defrosting frequency; determining a heat exchange temperature difference according to the target defrosting frequency, and controlling the unit to operate according to the heat exchange temperature difference.

In some embodiments, the step of determining the average defrosting frequency of the unit in the current climate includes: acquiring a meteorological parameter of an area where the unit is located; and calculating the average defrosting frequency of the unit according to the meteorological parameter and a frosting map determined by the unit.

In some embodiments, a horizontal coordinate of the frosting map is air temperature and a longitudinal coordinate is relative air humidity; the frosting map includes: a dew-forming area, a non-frosting area and a frosting area; the frosting area contains an equal-rate frosting curve and the frosting area is divided into various frosting sub-areas; and the frosting sub-areas at least include one of the followings: a light frost area, a moderate frosting area and a heavy frost area, wherein each frosting sub-area corresponds to one defrosting frequency respectively.

In some embodiments, the step of calculating the average defrosting frequency of the unit according to the frosting map includes: acquiring the defrosting frequency of each frosting sub-area; calculating a working condition proportion of each frosting sub-area respectively; and determining the average defrosting frequency of the unit according to the working condition proportion of each frosting sub-area and the corresponding defrosting frequency.

In some embodiments, the step of determining the target defrosting frequency according to the average defrosting frequency includes: acquiring the defrosting frequency of each frosting sub-area; and comparing the defrosting frequency of each frosting sub-area with the average defrosting frequency, determining all defrosting frequencies, less than the average defrosting frequency, in the defrosting frequencies of the frosting sub-areas, and determining one of all the defrosting frequencies less than the average defrosting frequency as the target defrosting frequency.

In some embodiments, the step of determining the heat exchange temperature difference according to the target defrosting frequency includes: establishing a mathematical model of the heat exchange temperature difference and a frosting rate change quantity according to the frosting map of the area where the unit is located; determining a corresponding frosting rate change quantity according to the target defrosting frequency; and substituting the frosting rate change quantity into the mathematical model to calculate the heat exchange temperature difference.

In some embodiments, the mathematical model is: $\Delta T' = A \times v' + B$, wherein $\Delta T'$ is the heat exchange temperature difference, $v'$ is the frosting rate change quantity, A is a first coefficient, and B is a second coefficient.

In some embodiments, the step of determining the corresponding frosting rate change quantity according to the target defrosting frequency includes: determining a frosting rate of the unit under a standard frosting working condition according to the frosting map; determining a frosting sub-area where the target defrosting frequency is located and determining a frosting rate corresponding to the frosting sub-area; and calculating a difference value between the frosting rate of the unit under the standard frosting working condition and the frosting rate corresponding to the frosting sub-area to serve as the frosting rate change quantity of the unit.

In some embodiments, after the step of controlling the unit to operate according to the heat exchange temperature difference, the method further includes: judging whether the unit achieves an anti-frosting control target; and if yes, controlling the unit to continuously operate according to the heat exchange temperature difference, if not, adjusting the heat exchange temperature difference and controlling the unit to operate according to the adjusted heat exchange temperature difference until the unit achieves the anti-frosting control target.

In some embodiments, the step of judging whether the unit achieves the anti-frosting control target includes: correcting the frosting map according to the heat exchange temperature difference; calculating a corrected average defrosting frequency of the unit according to the corrected frosting map; and judging whether the corrected average defrosting frequency is less than or equal to the target defrosting frequency, if yes, determining to achieve the anti-frosting control target, if not, determining not to achieve the anti-frosting control target.

In some embodiments, the step of adjusting the heat exchange temperature difference includes: adjusting a frosting rate change quantity of the unit; and substituting the adjusted frosting rate change quantity of the unit into the mathematical model to calculate an adjusted heat exchange temperature difference.

According to another aspect of embodiments of the present disclosure, an air conditioner anti-frosting control device is provided. The conditioner anti-frosting control device includes: a calculation module, configured to determine an average defrosting frequency of a unit in a current climate; a determining module, configured to determine a target defrosting frequency according to the average defrosting frequency; and a control module, configured to determine a heat exchange temperature difference according to the target defrosting frequency and control the unit to operate according to the heat exchange temperature difference.

According to still another aspect of embodiments of the present disclosure, an air conditioner unit is provided. The air conditioner unit includes the air conditioner anti-frosting control device according to the above embodiments.

According to yet another aspect of embodiments of the present disclosure, a computer device is provided. The computer device includes a memory, a processor and a computer program stored in the memory and capable of running on the processor, wherein the processor implements the air conditioner anti-frosting control method according to the above embodiments when executing the program.

According to yet another aspect of embodiments of the present disclosure, a storage medium containing a computer executable instruction is provided, wherein the computer executable instruction is configured to perform the air conditioner anti-frosting control method according to the above embodiments when being executed by a computer processor.

BRIEF DESCRIPTION OF THE ACCOMPANYING DRAWINGS

The accompanying drawings are used to provide further understanding of the present disclosure and constitute a part of the present disclosure. The exemplary embodiments of the present disclosure and the description thereof serve to explain the present disclosure, but do not constitute an improper limitation to the present disclosure. In the accompanying drawings.

DETAILED DESCRIPTION OF THE PREFERRED EMBODIMENTS

Figure 1:
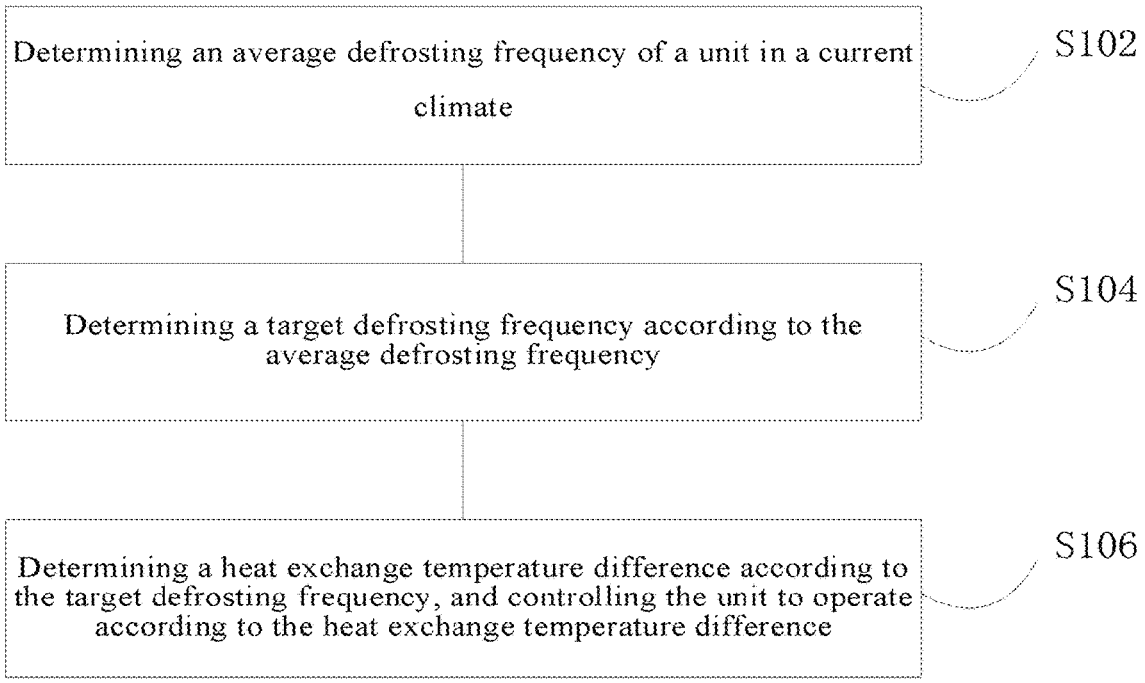
FIG. 1 is a flowchart of some embodiments of an air conditioner anti-frosting control method according to the present disclosure.

Description will be made in detail to exemplary embodiments, examples of which are illustrated in the accompanying drawings. When the following description hereinafter refers to the accompanying drawings, the same reference numerals in various drawings represent the same or similar elements, unless otherwise represented. The implementation manners set forth in the following description of exemplary embodiments do not represent all implementation manners consistent with the present disclosure. Instead, these implementation manners are merely examples of devices and methods consistent with aspects related to the present disclosure as recited in the appended claims.

In the related art known by the inventor, the performance of the air source heat pump under the nominal working condition is satisfactory. For example, as stipulated in some standards, the air source heat pump operates under the nominal working conditions (the temperature of a dry ball is 7° C. and the temperature of a wet ball is 6° C.), and 1.9 to 2.6 times of low-level heat should be absorbed from the ambient air, and 2.9 to 3.6 times of high-level heat is provided for users at every consumption of 1 KWH of electricity. However, when the air source heat pump operates in winter, the outdoor heat exchanger is often in a frosting working condition, which will face the frequent frosting problem, so the actual operation performance is affected, the building energy consumption is greatly increased, and the application and development of the air source heat pump is severely restricted. For the frequent frosting problem of the air conditioner unit in the related art, no effective solution has been proposed yet.

In view of this, the present disclosure provides an air conditioner anti-frosting control method and apparatus, so as to at least solve the frequent frosting problem of the air conditioner unit in prior art.

According to the frosting map-based air conditioner anti-frosting control method provided by the embodiments of the present disclosure, based on a sub-area frosting map, the defrosting frequency of a unit is determined and an anti-frosting target is drawn up, so that the air conditioner is controlled by calculating a heat exchange temperature difference under the anti-frosting target. By the above method, the frosting quantity during unit operation may be improved, the defrosting frequency is reduced, the actual operation performance of the unit is improved, and the frequent frosting problem of the air source heat pump is effectively solved.

Some embodiments of the present disclosure provide an air conditioner anti-frosting control method. The anti-frosting control method is directly applied to various air conditioner units, for example, an air source heat pump unit; or the anti-frosting control method is applied to other devices with part of air conditioner functions. During specific implementation, the anti-frosting control method is implemented by installing software and APP on the air conditioner unit or other devices or writing a corresponding program of a controller. Specifically, FIG. 1 shows a flowchart of some embodiments of the air conditioner anti-frosting control method. As shown in FIG. 1, the air conditioner anti-frosting control method includes the following steps S102-S106:

S102: determining an average defrosting frequency of a unit in a current climate;

S104: determining a target defrosting frequency according to the average defrosting frequency; and

S106: determining a heat exchange temperature difference according to the target defrosting frequency, and controlling the unit to operate according to the heat exchange temperature difference.

In the above embodiment, a frosting map-based air conditioner anti-frosting control method is provided. Based on a sub-area frosting map, the defrosting frequency of a unit is determined and an anti-frosting target is drawn up, so that the air conditioner is controlled by calculating a heat exchange temperature difference under the anti-frosting target. By the above method, the frosting quantity during unit operation can be improved, the defrosting frequency is reduced, the actual operation performance of the unit is improved, and the frequent frosting problem of the air source heat pump is effectively solved.

In some embodiments, the step of determining the average defrosting frequency of the unit in the current climate includes:

acquiring a meteorological parameter of an area where the unit is located; and calculating the average defrosting frequency of the unit according to the meteorological parameter and a frosting map determined by the unit.

Figure 2:
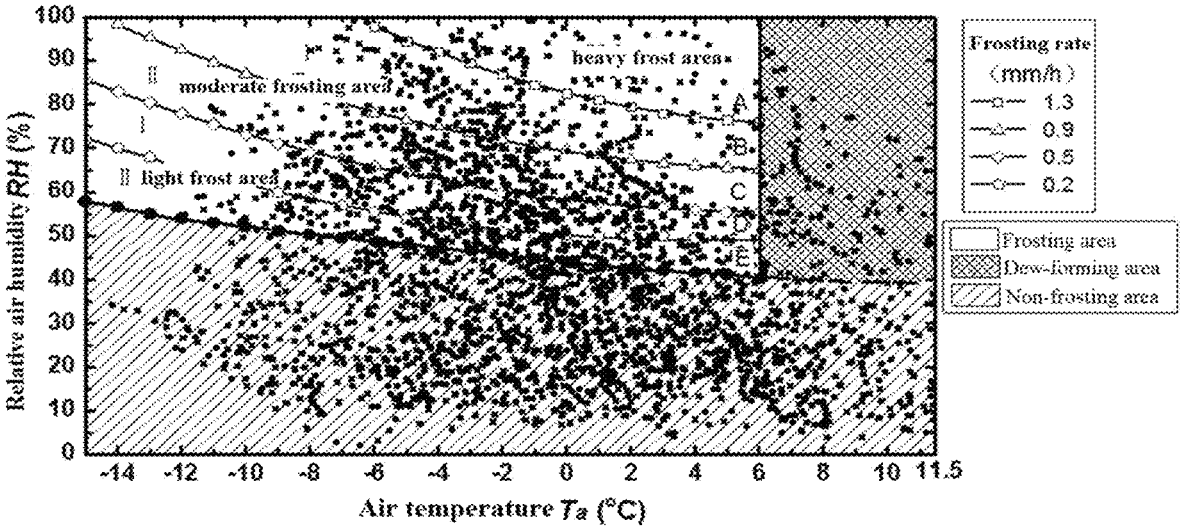
FIG. 2 is a schematic diagram of a sub-area frosting map according to some embodiments of the present disclosure.

The method provided by the present disclosure is based on the frosting map, also called a sub-area frosting map, which is a frosting distribution diagram. FIG. 2 shows frosting distribution of a typical unit under the typical annual meteorological condition. As shown in FIG. 2, a horizontal coordinate of the frosting map is air temperature and a longitudinal coordinate is relative air humidity. The frosting map includes: a dew-forming area, a non-frosting area and a frosting area. A critical dew-forming line divides the whole map into two parts, a lower side of the critical dew-forming line is the non-frosting area, an upper side of the critical dew-forming line is provided with a critical frosting line which is parallel with the longitudinal coordinate and the lower end of which ends at the critical dew-forming line. Above the critical dew-forming line, a left side of the critical frosting line is the frosting area and a right side of the critical frosting line is the dew-forming area.

The frosting area contains three equal-rate frosting curves for dividing the frosting area into various frosting sub-areas according to the frosting rate, namely, a light frost area, a moderate frosting area and a heave frost area, wherein each frosting sub-area corresponding to one defrosting frequency, and the frosting rate in each area is similar. The light frost area and the moderate frosting area each contains one equal-rate frosting curve for dividing the light frost area into an area I and an area II and dividing the general frost area into an area I and an area II. In this way, the frosting area in the frosting map in FIG. 1 is divided into five frosting areas in total, and the frosting rate of each equal-rate frosting curve is shown in a legend in FIG. 1.

The actual frosting degree in various regional climates may be clearly reflected through the sub-area frosting map, which is beneficial to determine the next anti-frosting target.

On the basis of the above frosting map, the step of calculating the average defrosting frequency of the unit according to the frosting map includes:

acquiring a defrosting frequency of each frosting sub-area;

calculating a working condition proportion of each frosting sub-area respectively; and determining the average defrosting frequency of the unit according to the working condition proportion of each frosting sub-area and the corresponding defrosting frequency.

Based on FIG. 2, the working condition proportion of each frosting sub-area, and calculating a defrosting frequency of the whole heating season in combination with the defrosting frequency of each sub-area, that is, the average defrosting frequency f1 is equal to 0.16 times/h.

The step of determining the target defrosting frequency according to the average defrosting frequency includes:

acquiring the defrosting frequency of each frosting sub-area;

comparing the defrosting frequency of each frosting sub-area with the average defrosting frequency, determining all defrosting frequencies, less than the average defrosting frequency, in the defrosting frequencies of the frosting sub-areas, and determining one of all the defrosting frequencies less than the average defrosting frequency as the target defrosting frequency.

According to the frosting map, the corresponding frosting rate of the typical unit at 2/1° C. is 1.4 mm/h, the unit is slightly frosted when the unit anti-frosting is positioned at the standard frosting working condition, the frosting rate corresponding to slight frosting is 0.1 mm/h, and the target defrosting frequency f0 is equal to 0.01 times/h.

In the embodiment of the present disclosure, various anti-frosting targets are designed according to the requirements of users and considering an economic factor (the lower the defrosting frequency, the more beneficial to energy saving); and according to various anti-frosting targets and by reducing the frosting area of the sub-area frosting map of the unit, the anti-frosting condition of the unit can be intuitively reflected and the actual frosting degree of the unit under all working conditions can be clearly embodied.

In some embodiments, the step of determining the heat exchange temperature difference according to the target defrosting frequency includes:

establishing a mathematical model of the heat exchange temperature difference and a frosting rate change quantity according to the frosting map of the area where the unit is located;

determining a corresponding frosting rate change quantity according to the target defrosting frequency; and substituting the frosting rate change quantity into the mathematical model to calculate the heat exchange temperature difference.

In some embodiments, the mathematical model is: $\Delta T'=A\times v'+B$, wherein $\Delta T'$ is the heat exchange temperature difference, v' is the frosting rate change quantity, A is a first coefficient, and B is a second coefficient. The frosting rate of the unit under the anti-frosting positioning (slight frosting) is 0.1 mm/h, the reduction value of the frosting rate is v'=1.3 mm/h, and the target heat exchange temperature difference $\Delta T=3°$ C. is calculated according to $\Delta T'=A\times v'+B$.

In some embodiments, the step of determining the corresponding frosting rate change quantity according to the target defrosting frequency includes:

determining a frosting rate of the unit under a standard frosting working condition according the frosting map;

determining a frosting sub-area where the target defrosting frequency is located and determining a frosting rate corresponding to the frosting sub-area; and calculating a difference value between the frosting rate of the unit under the standard frosting working condition and the frosting rate corresponding to the frosting sub-area to serve as the frosting rate change quantity of the unit.

In the above implementation manner, the preliminary anti-frosting control has been completed, that is, operating parameters of the air conditioner unit are determined according to the anti-frosting target. After the air conditioner unit operates according to the operating parameters, the embodiment of the present disclosure further verifies whether the above anti-frosting control method achieves the anti-frosting target, that is, whether it is effective, and proceeds to the next step according to the verification result. After the step of controlling the unit to operate according to the heat exchange temperature difference, the anti-frosting control method provided by the present disclosure further includes:

judging whether the unit achieves the anti-frosting control target; and if yes, controlling the unit to continuously operate according to the heat exchange temperature difference, if not, adjusting the heat exchange temperature difference and controlling the unit to operate according to the adjusted heat exchange temperature difference until the unit achieves the anti-frosting control target.

The step of judging whether the unit achieves the anti-frosting control target includes:

correcting the frosting map according to the heat exchange temperature difference;

calculating a corrected average defrosting frequency of the unit according to the corrected frosting map; and judging whether the corrected average defrosting frequency is less than or equal to the target defrosting frequency, if yes, determining to achieve the anti-frosting control target, if not, determining not to achieve the anti-frosting control target.

According to the sub-area frosting map and the anti-frosting target, a relation between the anti-frosting target and the frosting area in the frosting map is established, the frosting map is corrected, the actual frosting range and defrosting frequency of the unit after anti-frosting are quantified, and the actual frosting degree is intuitively reflected. The method has the characteristic of simplicity in control and high practicability.

In some embodiments, the step of adjusting the heat exchange temperature difference includes:

adjusting a frosting rate change quantity of the unit; and substituting the adjusted frosting rate change quantity of the unit into the mathematical model to calculate an adjusted heat exchange temperature difference.

Figure 3:
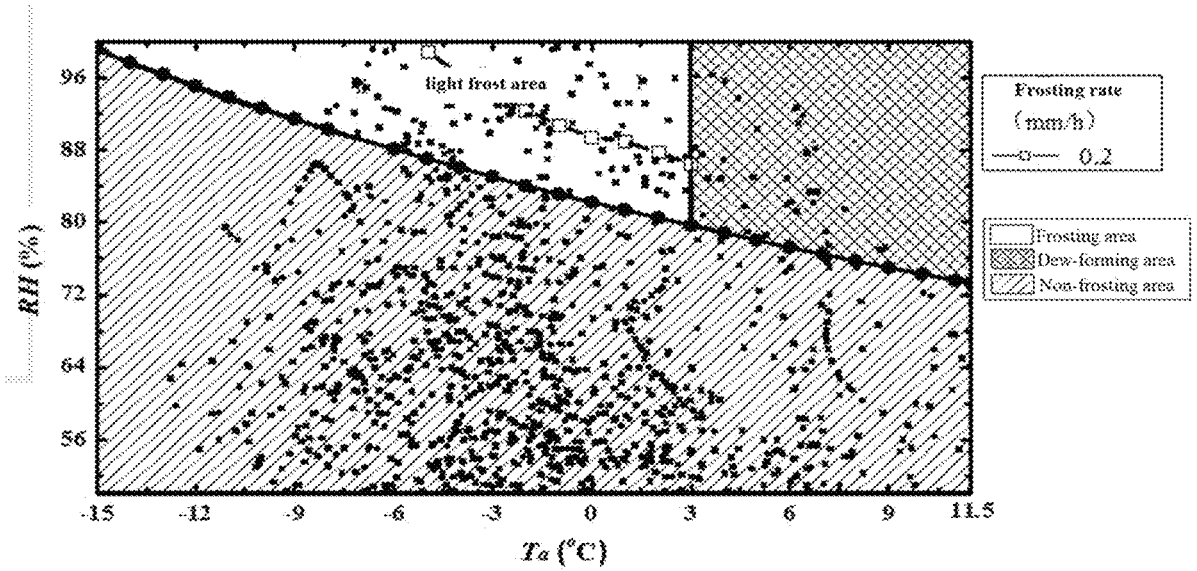
FIG. 3 is a schematic diagram of a corrected sub-area frosting map according to some embodiments of the present disclosure.

The frosting map is corrected on the basis of the target heat exchange temperature difference, and the corrected map is shown in FIG. 3. The range of the frosting area is reduced. The frosting area only includes the light frost area. Meanwhile, from the corrected map, the corresponding frosting rate under the standard frosting working condition is 0.1 mm/h, which coincides to the reduction value of the frosting rate. The defrosting frequency f2=0.01 times/h is calculated according to a new map, so that the designed anti-frosting target is met.

In order to verify the method, field test verification is performed under the standard frosting working condition. The heat exchange temperature difference of the outdoor heat exchanger of the unit reaches 3° C. by adjusting an operation relation between a compressor and a fan of the unit, which keeps the unit stably running for one frosting and defrosting cycle. The frosting rate is calculated to be 0.15 mm/h by testing the defrosting water quantity of the cycle unit and is slightly greater than the target frosting rate. Considering the testing error during defrosting, the test result achieves the anti-frosting target and verifies the accuracy and effectiveness of the anti-frosting control method.

The present disclosure provides an air source heat pump anti-frosting control method based on a sub-area frosting map. Based on the sub-area frosting map, a mathematical calculation model of a heat exchange temperature difference increment and a frosting rate increment is established, and the defrosting frequency of the unit is determined according to a typical annual meteorological parameter. Considering the problem of economic cost, an anti-frosting target is drawn up and a frosting rate adjusting value is selected, the calculation model calculates the heat exchange temperature difference under the anti-frosting target, the frosting map is corrected, and the defrosting frequency under the corrected map is determined for judgment.

Figure 4:
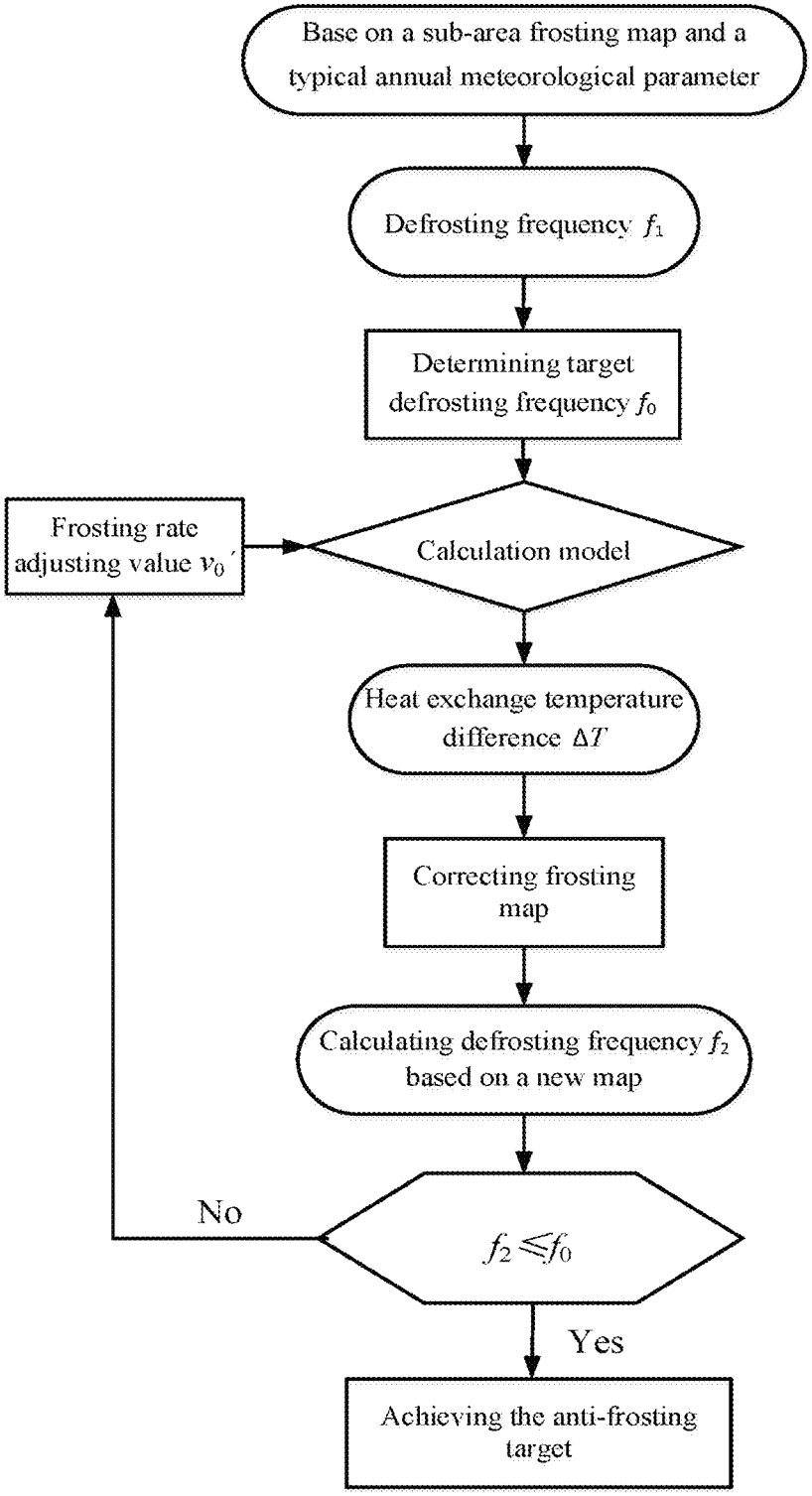
FIG. 4 is a flowchart of some other embodiments of an air conditioner anti-frosting control method according to the present disclosure.

In some other embodiments, as shown in FIG. 4, the anti-frosting control method provided by the present disclosure specifically includes the following steps:

first step: a mathematical model of a heat exchange temperature difference change quantity and a frosting rate change quantity is calculated based on a sub-area frosting map. Four equal-rate frosting lines are determined according to the sub-area frosting map respectively, namely, 0.2 mm/h, 0.5 mm/h, 0.9 mm/h and 1.3 mm/h. According to the corresponding heat exchange temperature difference, the mathematical calculation model of the heat exchange temperature difference change quantity and the frosting rate change quantity is established, that is, $\Delta T'=A\times v'+B$.

Second step: a defrosting frequency f1 is calculated in a typical annual climate according to typical annual meteorological parameters (hourly temperature and humidity) of a region and in combination with the sub-area frosting map, wherein the defrosting frequency is based on defrosting time; the corresponding defrosting time point when each area is frosted is considered as one-time frosting with a unit: times/h; and according to research on the frosting map from the heavy area, the moderate frosting area (I and II) and the light frost area (I and II), the defrosting frequencies are sequentially 2, 1.3, 1, 0.4 and 0.25 times/h.

Third step: an anti-frosting target is drawn up. According to the defrosting frequency f1 of the unit in the typical annual climate of the region and considering the problem of economic cost, a realizable target defrosting frequency f0 may be drawn up, that is, a target defrosting frequency.

Fourth step: the heat exchange temperature difference is calculated based on the calculation model and the frosting map is corrected. The frosting rate adjusting value under the prepared target is v0', $\Delta T'$ is calculated based on the above calculation model, and the heat exchange temperature difference is determined, so that an offset of the critical frosting line and dew-forming line of the sub-area frosting map is determined, and the frosting map is corrected.

Fifth step: the anti-frosting target is determined. A defrosting frequency f2 of the unit in the typical annual climate is calculated based on the corrected frosting map; the target defrosting frequency f0 is compared; and if $f2\leq f0$, the anti-frosting target is achieved, otherwise, the frosting rate v' is re-adjusted for recalculating until the anti-frosting target is achieved, so that anti-frosting is realized.

In the above embodiment, a frosting map-based air conditioner anti-frosting control method is provided. Based on a sub-area frosting map, the defrosting frequency of a unit is determined and an anti-frosting target is drawn up, so that the air conditioner is controlled by calculating a heat exchange temperature difference under the anti-frosting target. By the above method, the frosting quantity during unit operation may be improved, the defrosting frequency is reduced, the actual operation performance of the unit is improved, and the frequent frosting problem of the air source heat pump is effectively solved.

Figure 5:
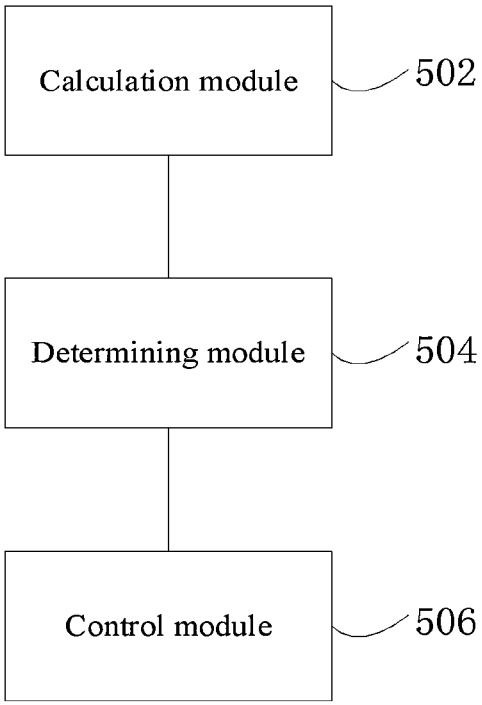
FIG. 5 is a structural block diagram of some embodiments of an air conditioner anti-frosting control device according to the present disclosure.

Based on the anti-frosting control method provided by the above embodiment, the present disclosure further provides an air conditioner anti-frosting control device. FIG. 5 shows a structural block diagram of some embodiments of the air conditioner anti-frosting control device. The conditioning anti-frosting control device includes:

a calculation module 502, configured to determine an average defrosting frequency of a unit in a current climate;

a determining module 504, connected to the calculation module 502 and configured to determine a target defrosting frequency according to the average defrosting frequency; and a control module 506, connected to the determining module 504 and configured to determine a heat exchange temperature difference according to the target defrosting frequency and control the unit to operate according to the heat exchange temperature difference.

In the above embodiment, a frosting map-based air conditioner anti-frosting control device is provided. Based on a sub-area frosting map, a defrosting frequency of a unit is determined and an anti-frosting target is drawn up, so that the air conditioner is controlled by calculating a heat exchange temperature difference under the anti-frosting target. By the above method, the frosting quantity during unit operation may be improved, the defrosting frequency is reduced, the actual operation performance of the unit is improved, and the frequent frosting problem of the air source heat pump is effectively solved.

In some embodiments, the calculation module 502 includes: a meteorological parameter acquisition unit, configured to acquire a meteorological parameter of an area where a unit is located; and an average defrosting frequency determining unit, configured to calculating an average defrosting frequency of the unit according to the meteorological parameter and the frosting map determined by the unit.

A horizontal coordinate of the frosting map is air temperature and a longitudinal coordinate is relative air humidity; the frosting map includes: a dew-forming area, a non-frosting area and a frosting area; the frosting area contains an equal-rate frosting curve and the frosting area is divided into various frosting sub-areas; and the frosting sub-areas at least include one of the followings: a light frost area, a moderate frosting area and a heavy frost area, wherein each frosting sub-area corresponds to one defrosting frequency respectively.

In some embodiments, the calculation module 502 includes: a first acquisition unit, configured to acquire a defrosting frequency of each frosting sub-area; a first calculation unit, configured to calculating a working condition proportion of each frosting sub-area respectively; and a first determining unit, configured to determine an average defrosting frequency of the unit according to the working condition proportion of each frosting sub-areas and the corresponding defrosting frequency.

In some embodiments, the determining module 504 includes: a second acquisition unit, configured to acquire a defrosting frequency of each frosting sub-area; and a second determining unit, configured to compare the defrosting frequency of each frosting sub-area with the average defrosting frequency, determine all defrosting frequencies, less than the average defrosting frequency, in the defrosting frequencies of the frosting sub-areas, and determine one of all the defrosting frequencies less than the average defrosting frequency as the target defrosting frequency.

In some embodiments, the control module 506 includes: a modeling unit, configured to establish a mathematical model of the heat exchange temperature difference and a frosting rate change quantity according to the frosting map of the area where the unit is located; a third determining unit, configured to determine a corresponding frosting rate change quantity according to the target defrosting frequency; and a second calculation unit, configured to substitute the frosting rate change quantity into the mathematical model to calculate the heat exchange temperature difference.

The mathematical model is: $\Delta T'=A\times V'+B$, wherein $\Delta T'$ is the heat exchange temperature difference, $v'$ is the frosting rate change quantity, A is a first coefficient, and B is a second coefficient.

In some embodiments, the third determining unit includes: a first determining sub-unit, configured to determining a frosting rate of the unit under the standard frosting working condition according to a frosting map; a second determining sub-unit, configured to determine a frosting sub-area where the target defrosting frequency is located and determine a frosting rate corresponding to the frosting sub-area; and a calculation sub-unit, configured to calculate a difference value between the frosting rate of the unit under the standard frosting working condition and the frosting rate corresponding to the frosting sub-area to serve as the frosting rate change quantity of the unit.

In some embodiments, the air conditioner anti-frosting control device further includes: a judgment module, configured to judge whether the unit achieves the anti-frosting control target after controlling the unit to operate according to the heat exchange temperature difference; a maintaining module, configured to control the unit to continuously operate according to the heat exchange temperature difference when the unit achieves the anti-frosting control target; and an adjusting module, configured to adjust the heat exchange temperature difference when the unit does not achieve the anti-frosting control target and control the unit to operate according to the adjusted heat exchange temperature difference until the unit achieves the anti-frosting control target.

The judgment module includes: a correction unit, configured to correct the frosting map according to the heat exchange temperature difference; a third calculation unit, configured to calculate the corrected average defrosting frequency of the unit according to the corrected frosting map; a judgment unit, configured to judge whether the corrected average defrosting frequency of the unit is less than or equal to the target defrosting frequency; and a result determining unit, configured to determine to achieve the anti-frosting control target when the corrected average defrosting frequency is less than or equal to the target defrosting frequency and determine not to achieve the anti-frosting control target when the corrected average defrosting frequency is greater than the target defrosting frequency.

In some embodiments, the adjusting module includes: an adjusting unit, configured to adjust the frosting rate change quantity of the unit; and a third calculation unit, configured to substitute the adjusted frosting rate change quantity of the unit into the mathematical model to calculate the adjusted heat exchange temperature difference.

For the air conditioner anti-frosting control device in the foregoing embodiment, a specific manner of each unit and module performing operation has already been described in the method-related embodiment in detail, which is no longer described herein in detail.

Based on the air conditioner anti-frosting control device provided by the above embodiment, an embodiment of the present disclosure further provides an air conditioner unit, including the above air conditioner anti-frosting control device.

In the above implementation manner, an air conditioner unit is provided. Based on a sub-area frosting map, the defrosting frequency of a unit is determined and an anti-frosting target is drawn up, so that the air conditioner is controlled by calculating a heat exchange temperature difference under the anti-frosting target. By the above method, the frosting quantity during unit operation may be improved, the defrosting frequency is reduced, the actual operation performance of the unit is improved, and the frequent frosting problem of the air source heat pump is effectively solved.

Based on the air conditioner anti-frosting control method provided by the above embodiment, an embodiment of the present disclosure further provides a computer device, including a memory, a processor and a computer program stored in the memory and capable or running on the processor, wherein the processor implements the above air conditioner anti-frosting control method when executing the above program.

In the above implementation manner, a frosting map-based air conditioner anti-frosting control method is provided. Based on a sub-area frosting map, a defrosting frequency of a unit is determined and an anti-frosting target is drawn up, so that the air conditioner is controlled by calculating a heat exchange temperature difference under the anti-frosting target. By the above method, the frosting quantity during unit operation may be improved, the defrosting frequency is reduced, the actual operation performance of the unit is improved, and the frequent frosting problem of the air source heat pump is effectively solved.

Based on the air conditioner anti-frosting control method provided by the above embodiment, an embodiment of the present disclosure further provides a storage medium containing a computer executable instruction. The computer executable instruction is configured to perform the above air conditioner anti-frosting control method when being executed by a computer processor.

In the above implementation manner, a frosting map-based air conditioner anti-frosting control method is provided. Based on a sub-area frosting map, a defrosting frequency of a unit is determined and an anti-frosting target is drawn up, so that the air conditioner is controlled by calculating a heat exchange temperature difference under the anti-frosting target. By the above method, the frosting quantity during unit operation may be improved, the defrosting frequency is reduced, the actual operation performance of the unit is improved, and the frequent frosting problem of the air source heat pump is effectively solved.

Other embodiments of the present disclosure will be apparent to those skilled in the art from consideration of the specification and practice of the present disclosure. The present disclosure is intended to cover any variations, uses, or adaptive changes of the present disclosure following the general principles thereof and including common knowledge or commonly used technical measures which are not disclosed herein. The specification and embodiments are considered as exemplary only, and the true scope and spirit of the present disclosure are indicated by the claims.

It should be understood that the present disclosure is not limited to the exact structure that has been described above and illustrated in the accompanying drawings, and that various modifications and changes may be made without departing from the scope thereof. The scope of the present disclosure is only limited by the appended claims.

The invention claimed is:

1. An air conditioner anti-frosting control method, comprising:

determining an average defrosting frequency of an air conditioner unit in a current climate;

determining a target defrosting frequency according to the average defrosting frequency; and determining a heat exchange temperature difference according to the target defrosting frequency and controlling the air conditioning unit to operate according to the heat exchange temperature difference, wherein determining the average defrosting frequency of the air conditioner unit in the current climate further comprises:

acquiring a meteorological parameter of an area where the air conditioner unit is located; and calculating the average defrosting frequency of the air conditioner unit according to the meteorological parameter and a frosting map determined by the air conditioner unit;

wherein a horizontal coordinate of the frosting map is air temperature and a longitudinal coordinate is relative air humidity, the frosting map comprises: a dew-forming area, a non-frosting area and a frosting area; the frosting area contains equal-rate frosting curves for dividing the frosting area into various frosting sub-areas, and the frosting sub-areas comprise at least one of: a first frost area. a second frosting area and a third frost area, each frosting sub-area corresponding to one defrosting frequency, the defrosting frequency of the first frost area is less than a first preset defrosting frequency, the defrosting frequency of the third frost area is greater than a second preset defrosting frequency, the defrosting frequency of the second frosting area is between the first preset defrosting frequency and the second preset defrosting frequency, and the first preset defrosting frequency is less than the second preset defrosting frequency.

2. The air conditioner anti-frosting control method according to claim 1, wherein calculating the average defrosting frequency of the air conditioner unit according to the frosting map further comprises:

acquiring the defrosting frequency of each of the frosting sub-areas;

calculating a working condition proportion of each of the frosting sub-areas respectively; and determining the average defrosting frequency of the air conditioner unit according to the working condition proportion of each of the frosting sub-areas and the corresponding defrosting frequency.

3. The air conditioner anti-frosting control method according to claim 1, wherein determining the target defrosting frequency according to the average defrosting frequency further comprises:

acquiring the defrosting frequency of each of the frosting sub-areas; and comparing the defrosting frequency of each of the frosting sub-areas with the average defrosting frequency, determining all defrosting frequencies, less than the average defrosting frequency, in the defrosting frequencies of the frosting sub-areas, and determining one of all the defrosting frequencies less than the average defrosting frequency as the target defrosting frequency.

4. The air conditioner anti-frosting control method according to claim 3, wherein determining the heat exchange temperature difference according to the target defrosting frequency further comprises:

establishing a mathematical model of the heat exchange temperature difference and a frosting rate change quantity according to the frosting map of the area where the air conditioner unit is located;

determining a corresponding frosting rate change quantity according to the target defrosting frequency; and substituting the frosting rate change quantity into the mathematical model to calculate the heat exchange temperature difference.

5. The air conditioner anti-frosting control method according to claim 4, wherein the mathematical model is:

$\Delta T' = A \times v' + B$, $\Delta T'$ being the heat exchange temperature difference, $v'$ being the frosting rate change quantity, A being a first coefficient, and B being a second coefficient.

6. The air conditioner anti-frosting control method according to claim 4, wherein determining the corresponding frosting rate change quantity according to the target defrosting frequency further comprises:

determining a frosting rate of the air conditioner unit under a standard frosting working condition according to the frosting map;

determining a frosting sub-area where the target defrosting frequency is located and determining a frosting rate corresponding to the frosting sub-area; and calculating a difference value between the frosting rate of the air conditioner unit under the standard frosting working condition and the frosting rate corresponding to the frosting sub- area to serve as the frosting rate change quantity of the air conditioner unit.

7. The air conditioner anti-frosting control method according to claim 4, after controlling the air conditioner unit to operate according to the heat exchange temperature difference, the method further comprising:

judging whether the air conditioner unit achieves an anti-frosting control target; and if yes, controlling the air conditioner unit to continuously operate according to the heat exchange temperature difference, if not, adjusting the heat exchange temperature difference, and controlling the air conditioner unit to operate according to the adjusted heat exchange temperature difference until the air conditioner unit achieves the anti-frosting control target.

8. The air conditioner anti-frosting control method according to claim 7, wherein judging whether the air conditioner unit achieves the anti-frosting control target further comprises:

correcting the frosting map according to the heat exchange temperature difference;

calculating a corrected average defrosting frequency of the air conditioner unit according to the corrected frosting map; and judging whether the corrected average defrosting frequency is less than or equal to the target defrosting frequency, if yes, determining to achieve the anti-frosting control target, if not, determining not to achieve the anti-frosting control target.

9. The air conditioner anti-frosting control method according to claim 7, wherein adjusting the heat exchange temperature difference further comprises:

adjusting a frosting rate change quantity of the air conditioner unit; and substituting the adjusted frosting rate change quantity of the air conditioner unit into the mathematical model to calculate an adjusted heat exchange temperature difference.

10. A computer device, comprising a memory, a processor and a computer program stored in the memory and capable of running on the processor, wherein the processor implements the air conditioner anti-frosting control method according to claim 1 when executing the program.

11. An air conditioner unit, comprising the computer device according to claim 10.

12. A storage medium containing a computer executable instruction, wherein the computer executable instruction is configured to perform the air conditioner anti-frosting control method according to claim 1 when being executed by a computer processor.

* * * * *